US011577926B2

(12) United States Patent
Furumido et al.

(10) Patent No.: US 11,577,926 B2
(45) Date of Patent: Feb. 14, 2023

(54) SHEET PROCESSING APPARATUS

(71) Applicant: SEIKO EPSON CORPORATION, Tokyo (JP)

(72) Inventors: Tsuyoshi Furumido, Shiojiri (JP); Kenji Uchibori, Matsumoto (JP); Atsushi Nakazawa, Matsumoto (JP); Akinobu Nakahata, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 434 days.

(21) Appl. No.: 16/905,464

(22) Filed: Jun. 18, 2020

(65) Prior Publication Data

US 2020/0399085 A1 Dec. 24, 2020

(30) Foreign Application Priority Data

Jun. 20, 2019 (JP) ..... JP2019-114257

(51) Int. Cl.
*B65H 9/10* (2006.01)
*B65H 31/34* (2006.01)
*B65H 31/30* (2006.01)

(52) U.S. Cl.
CPC ..... *B65H 9/101* (2013.01); *B65H 31/3009* (2013.01); *B65H 31/3081* (2013.01); *B65H 31/34* (2013.01); *B65H 2301/363* (2013.01); *B65H 2301/3621* (2013.01)

(58) Field of Classification Search
CPC ..... B65H 9/101; B65H 31/3009; B65H 31/3081; B65H 31/34; B65H 2301/3621; B65H 2301/363
See application file for complete search history.

(56) References Cited

U.S. PATENT DOCUMENTS

| | | | | |
|---|---|---|---|---|
| 6,814,350 | B2 * | 11/2004 | Saegusa | B65H 31/00 270/58.11 |
| 7,014,183 | B2 * | 3/2006 | Tamura | B65H 33/08 271/220 |
| 8,177,227 | B2 * | 5/2012 | Uchiyama | B65H 31/10 271/226 |
| 10,351,383 | B2 * | 7/2019 | Saito | B65H 31/36 |
| 10,604,372 | B2 * | 3/2020 | Ohata | B65H 31/38 |
| 11,319,181 | B2 * | 5/2022 | Furumido | B65H 31/10 |

(Continued)

FOREIGN PATENT DOCUMENTS

JP 2002-255432 9/2002

*Primary Examiner* — Leslie A Nicholson, III
(74) *Attorney, Agent, or Firm* — Workman Nydegger

(57) ABSTRACT

A sheet processing apparatus includes: a processing tray section having a sheet mounting surface on which a transported sheet is mounted and a processing section that performs processing on the sheet; a side edge alignment section that is provided on the processing tray section and aligns a side edge of the sheet; a lower support section that is provided downstream of the processing tray section in a transport direction of the sheet and supports the sheet from below; and a discharge tray located below the lower support section. The side edge alignment section performs a shift operation of shifting the sheet in a shift direction orthogonal to the transport direction of the sheet. The lower support section moves in the shift direction in conjunction with a movement of the sheet in a state of supporting the sheet from below during the shift operation by the side edge alignment section.

12 Claims, 13 Drawing Sheets

(56) References Cited

U.S. PATENT DOCUMENTS

| | | | | |
|---|---|---|---|---|
| 2015/0014916 | A1* | 1/2015 | Saito | B65H 31/34<br>271/185 |
| 2019/0225446 | A1* | 7/2019 | Rasmussen | B65H 29/26 |

* cited by examiner

SHEET PROCESSING APPARATUS

The present application is based on, and claims priority from JP Application Serial Number 2019-114257, filed Jun. 20, 2019, the disclosure of which is hereby incorporated by reference herein in its ultimately.

BACKGROUND

1. Technical Field

The present disclosure relates to a sheet processing apparatus capable of performing a shift operation of mounting a sheet such as paper transported by a transport section and shifting the sheet in a direction intersecting a transport direction of paper.

2. Related Art

JP-A-2002-255432 discloses a sheet post-processing apparatus capable of performing a shift operation on a sheet. JP-A-2002-255432 describes that the sheet post-processing apparatus has a structure in which a bundle of stacked sheets S is shifted by an alignment unit 25. The alignment unit 25 has a structure for shifting a part of the bundle of sheets by pinching the part of the bundle of sheets in the longitudinal direction.

However, JP-A-2002-255432 neither describes nor suggests a possibility that long paper of, for example, A3 size, that is, a long sheet may be inclined by the shift operation.

SUMMARY

According to an aspect of the present disclosure, there is provided a sheet processing apparatus including: a transport section transporting a sheet; a processing tray section having a sheet mounting surface on which the transported sheet is mounted and a processing section that performs processing on the sheet; a side edge alignment section that is provided on the processing tray section and aligns a side edge of the sheet; a lower support section that is provided downstream of the processing tray section in a transport direction of the sheet and supports the sheet from below; and a discharge tray located below the lower support section in a sheet stacking direction orthogonal to the sheet mounting surface of the processing tray section. The side edge alignment section performs a shift operation of shifting the sheet in a shift direction orthogonal to the transport direction of the sheet. The lower support section moves in the shift direction in conjunction with a movement of the sheet in a state of supporting the sheet from below during the shift operation by the side edge alignment section.

DESCRIPTION OF EXEMPLARY EMBODIMENTS

Figure 1:
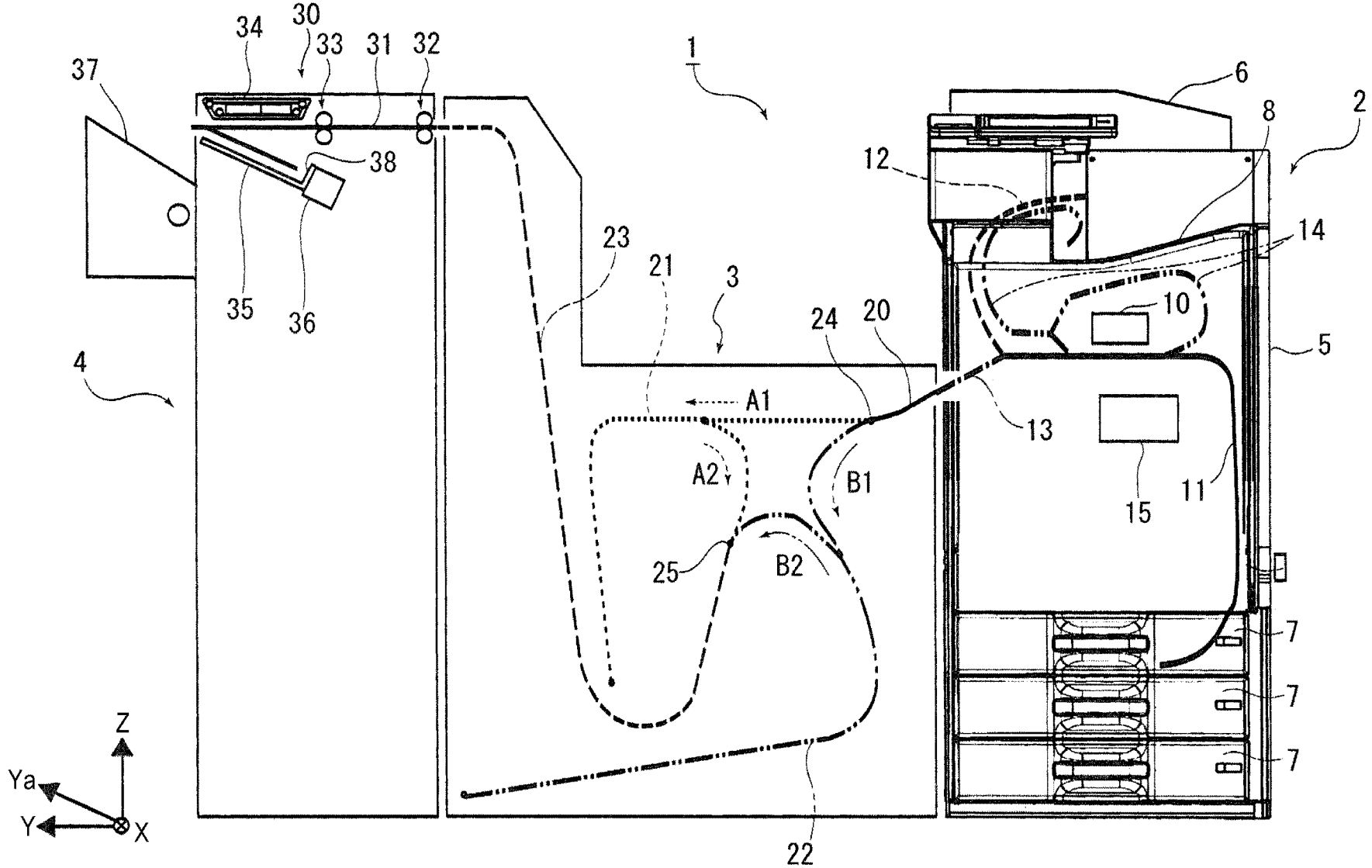
FIG. 1 is a schematic view of a recording system.

First, the present disclosure will be schematically described.

A sheet processing apparatus according to a first aspect of the present disclosure for solving the above-mentioned problems includes: a transport section transporting a sheet; a processing tray section having a sheet mounting surface on which the transported sheet is mounted and a processing section that performs processing on the sheet; a side edge alignment section that is provided on the processing tray section and aligns a side edge of the sheet; a lower support section that is provided downstream of the processing tray section in a transport direction of the sheet and supports the sheet from below; and a discharge tray located below the lower support section in a sheet stacking direction orthogonal to the sheet mounting surface of the processing tray section. The side edge alignment section performs a shift operation of shifting the sheet in a shift direction orthogonal to the transport direction of the sheet. The lower support section moves in the shift direction in conjunction with a movement of the sheet in a state of supporting the sheet from below during the shift operation by the side edge alignment section.

According to this aspect, the lower support section moves in a shift direction in conjunction with the movement of the sheet in a state of supporting the sheet from below during the shift operation by the side edge alignment section. In other words, during the shift operation of the sheet by the side edge alignment section, auxiliaries of the support from below by the lower support section located downstream of the side edge alignment section are added, so that a possibility that the sheet is inclined during the shift operation can be reduced.

In the sheet processing apparatus of a second aspect of the present disclosure, according to the first aspect, the side edge alignment section includes a set of a first alignment portion and a second alignment portion located on both sides of the sheet in a width direction, and the first alignment portion and the second alignment portion perform the shift operation in a state of pinching the sheet in the width direction.

According to this aspect, the first alignment portion and the second alignment portion included in the side edge alignment section perform the shift operation in a state of pinching the sheet in the width direction. As described above, the first alignment portion and the second alignment portion perform the shift operation in a state of pinching the sheet in the width direction. Therefore, the sheet during the shift movement is stabilized as compared to a state in which the sheet is simply supported from below by the side edge alignment section. Thus, the shift operation can be stably performed.

In the sheet processing apparatus of a third aspect of the present disclosure, according to the first or second aspect, the lower support section includes a set of a first lower support and a second lower support supporting the sheet from below on both sides in a width direction, and the first lower support and the second lower support move in the shift direction in a state of pinching the sheet from both sides in the width direction, during the shift operation.

According to this aspect, the first lower support and the second lower support included in the lower support section move in the shift direction in a state of pinching the sheet from both sides in the width direction, during the shift operation. Therefore, the sheet during the shift movement is stabilized as compared to a state in which the sheet is simply supported from below by the lower support section. Thus, the shift operation can be stably performed.

A sheet processing apparatus according to a fourth aspect of the present disclosure includes: a transport section transporting a sheet; a processing tray section on which the transported sheet is mounted and which performs processing on the sheet; a side edge alignment section that is provided on the processing tray section and aligns a side edge of the sheet; a lower support section that is provided downstream of the processing tray section in a transport direction of the sheet and supports the sheet from below; and a discharge tray located below the lower support section in a sheet stacking direction orthogonal to a sheet mounting surface of the processing tray section. The lower support section performs a shift operation of shifting the sheet in a shift direction orthogonal to the transport direction of the sheet.

According to this aspect, the lower support section is provided downstream of the processing tray section in the transport direction of the sheet. Therefore, an overall structure such as a size and a shape of the lower support section can be set independently of the processing tray section.

Therefore, firstly, it is possible to provide a structure in which the shift operation is performed only by the lower support section. It is possible to cope with a long sheet in a longitudinal direction. Further, by setting a contact area of a portion supporting the sheet to be large, the sheet can be stabilized during the shift movement by the lower support section.

According to this aspect, a side shape of the sheet viewed in the shift movement direction is not a straight line but a non-linear shape such as a Z shape or an S shape. Therefore, the sheet is in a state in which the sheet is stiff with respect to an acting force received during the shift operation by the lower support section, and the sheet can be stabilized during the movement in the shift direction.

In the sheet processing apparatus of a fifth aspect of the present disclosure, according to the fourth aspect, the lower support section includes a set of a first lower support and a second lower support supporting the sheet from below on both sides in a width direction, and the first lower support and the second lower support perform the shift operation in a state of pinching the sheet from both sides in the width direction, during the shift operation.

According to this aspect, the first lower support and the second lower support included in the lower support section perform the shift operation in a state of pinching the sheet from both sides in the width direction. Therefore, the sheet during the shift movement is stabilized as compared to a state in which the sheet is simply supported from below by the lower support section. Thus, the shift operation can be stably performed.

In the sheet processing apparatus of a sixth aspect of the present disclosure, according to the fourth or fifth aspect, the side edge alignment section moves in the shift direction in conjunction with a movement of the sheet during the shift operation.

According to this aspect, the side edge alignment section moves in the shift direction in conjunction with the movement of the sheet. As described above, the side edge alignment section moves in conjunction with the movement of the sheet. Therefore, the sheet during the shift movement can be stabilized as compared to a state in which the sheet is shifted by the lower support section. Thus, the shift operation can be stably performed.

In the sheet processing apparatus of a seventh aspect of the present disclosure, according to any one of the first to sixth aspects, an upstream end of the lower support section is located below a downstream end of the processing tray section in the sheet stacking direction orthogonal to the sheet mounting surface of the processing tray section.

According to this aspect, the upstream end of the lower support section is located below the downstream end of the processing tray section. Therefore, a side shape of the sheet viewed in the shift movement direction is not a straight line but a non-linear shape such as a Z shape or an S shape. Therefore, the sheet is in a state in which the sheet is stiff, that is, the rigidity increases with respect to an acting force received during the shift operation, and the sheet can be stabilized during the movement in the shift direction.

In the sheet processing apparatus of an eighth aspect of the present disclosure, according to any one of the first to seventh aspects, the lower support section is provided to be inclined with a downstream end upward with respect to a horizontal direction, and a rear end alignment surface that aligns a rear end of the sheet is provided at an upstream end of the lower support section in the transport direction of the sheet.

According to this aspect, a rear end alignment surface for aligning the rear end of the sheet is provided at the upstream end of the lower support section, in which the support surface of the sheet is inclined with the front end in the transport direction of the sheet facing upward. Therefore, the alignment is performed for arranging the rear end of the sheet by the rear end alignment surface with respect to a bundle of sheets of a state of being supported by the lower support section, and thereby the sheet can be discharged to the discharge tray.

In the sheet processing apparatus of a ninth aspect of the present disclosure, according to any one of the first to eighth aspects, the lower support section is configured to move between a support position for supporting the sheet and a retreat position, and causes the sheet to be discharged to the discharge tray by moving from the support position to the retreat position.

According to this aspect, the lower support section discharges the sheet to the discharge tray by moving from the support position to the retreat position. Therefore, the lower support section moves to a predetermined shift position and then moves from the support position to the retreat position, and thereby the sheet can be easily discharged to the predetermined shift position. Further, in this case, the discharge operation can be performed without the sheet discharged later coming into contact with the sheet already discharged on the discharge tray.

EMBODIMENTS

Hereinafter, embodiments of the present disclosure will be specifically described with reference to the drawings.

An XYZ coordinate system illustrated in each drawing is an orthogonal coordinate system, and an X-axis direction is a width direction of the sheet and also a depth of the apparatus. A Y-axis direction is a width direction of the apparatus, and a Z-axis direction is a vertical direction, that is, a height direction of the apparatus. A Ya-axis direction indicates a sheet discharge direction in a sheet discharge device 30 described later, and in the present embodiment, a +Ya direction and a +Y direction form an acute angle. The +Ya direction of the Ya-axis direction is the sheet discharge direction in the sheet discharge device 30 and is downstream in the sheet discharge direction. Further, a −Ya direction is an opposite direction to the sheet discharge direction in the sheet discharge device 30 and is upstream in the sheet discharge direction. The X-axis direction is the width direction that is a direction intersecting the Ya-axis direction.

Recording System

First, an overall configuration of a recording system including a sheet processing apparatus according to an embodiment of the present disclosure will be described with reference to FIGS. 1 to 3.

A recording system 1 illustrated in FIG. 1 includes, for example, a recording unit 2, an intermediate unit 3, and a processing unit 4 which is the sheet processing apparatus in order from right to left in FIG. 1.

The recording unit 2 includes a line head 10 as recording means for recording on a sheet. The sheet includes, for example, a recording sheet, and the sheet is hereinafter referred to as a sheet P.

The intermediate unit 3 receives the sheet P after recording, from the recording unit 2 and delivers the sheet P to the processing unit 4 that is the sheet processing apparatus. The processing unit 4 includes the sheet discharge device 30 discharging the sheet P after recording in the recording unit 2, and includes a processing section 36 performing predetermined processing on the sheet P mounted on a processing tray section 35 as a stacking tray included in the sheet discharge device 30.

In the recording system 1, the recording unit 2, the intermediate unit 3, and the processing unit 4 are coupled to each other, so that the sheet P can be transported from the recording unit 2 to the processing unit 4.

The recording system 1 is configured such that a recording operation or the like on the sheet P in the recording unit 2, the intermediate unit 3, and the processing unit 4 can be input from an operation panel (not illustrated). The operation panel can be provided, for example, in the recording unit 2.

Hereinafter, schematic configurations of the recording unit 2, the intermediate unit 3, and the processing unit 4 will be described in this order.

Recording Unit

The recording unit 2 is configured as a multifunction machine including a printer section 5 including the line head 10 that performs recording by ejecting ink, which is an example of a liquid, onto the sheet P, and a scanner section 6. In the present embodiment, the printer section 5 is configured as an inkjet printer.

A plurality of sheet storage cassettes 7 are provided below the apparatus of the recording unit 2. The sheet P stored in the sheet storage cassette 7 is sent to a recording area through a transport path 11 in the recording unit 2 illustrated by a solid line in FIG. 1, and the recording operation is performed by the line head 10. The sheet P after recording by the line head 10 is sent through a first discharge path 12 which is a path for discharging the sheet P to a post-recording discharge tray 8 provided above the line head 10, or through a second discharge path 13 which is a path for sending the sheet P to the intermediate unit 3. In the recording unit 2 in FIG. 1, the first discharge path 12 is indicated by a broken line, and the second discharge path 13 is indicated by a one-dotted chain line.

The recording unit 2 includes a reversing path 14 indicated by a two-dotted chain line, and is configured to be able to perform double-sided recording in which recording on a first surface of the sheet P is performed and then the sheet P is reversed, and recording is performed on a second surface.

In each of the transport path 11, the first discharge path 12, the second discharge path 13, and the reversing path 14, one or more pairs of transport rollers (not illustrated) are disposed as an example of a unit that transports the sheet P.

The recording unit 2 is provided with a control section 15 that controls operations related to transport and recording of the sheet P in the recording unit 2. The control section 15 can be configured to be able to control not only the recording unit 2 but also various operations in the processing unit 4 described below.

Intermediate Unit

The intermediate unit 3 is configured to be disposed between the recording unit 2 and the processing unit 4, receive, through a receiving path 20, the sheet P after recording delivered from the recording unit 2 through the second discharge path, and transport the sheet P to the processing unit 4. The receiving path 20 is indicated by a solid line in the intermediate unit 3 illustrated in FIG. 1.

In the intermediate unit 3, there are two transport paths for transporting the sheet P. The first transport path is a path that transports the sheet from the receiving path 20 to a discharge path 23 via a first switchback path 21. The second path is a path that transports the sheet from the receiving path 20 to the discharge path 23 via a second switchback path 22.

The first switchback path 21 is a path for receiving the sheet in a direction of an arrow A1 and then switching back the sheet P in a direction of an arrow A2. The second switchback path 22 is a path for receiving the sheet in a direction of an arrow B1 and then switching back the sheet in a direction of an arrow B2.

The receiving path 20 branches into the first switchback path 21 and the second switchback path 22 at a branching portion 24. Further, the first switchback path 21 and the second switchback path 22 join at a junction portion 25. Therefore, even if the sheet P is sent from the receiving path 20 to any of the switchback paths, the sheet P can be delivered to the processing unit 4 through the common discharge path 23.

In each of the receiving path 20, the first switchback path 21, the second switchback path 22, and the discharge path 23, one or more transport roller pairs (not illustrated) are disposed.

When recording is continuously performed on a plurality of sheets P in the recording unit 2, the sheet P entering the intermediate unit 3 is sent alternately to the transport path through the first switchback path 21 and to the transport path through the second switchback path 22. Therefore, a throughput of the sheet transport in the intermediate unit 3 can be increased.

It is also possible to adopt a recording system in which the intermediate unit 3 is omitted. That is, the processing unit can be directly coupled to the recording unit 2.

When the sheet P after recording in the recording unit 2 is sent to the processing unit 4 via the intermediate unit 3, a transport time is longer than that when the sheet P is directly sent from the recording unit 2 to the processing unit 4. Therefore, ink on the sheet P can be further dried before being transported to the processing unit 4.

Processing Unit

The processing unit 4 includes the sheet discharge device 30 that discharges the sheet P received from the intermediate unit 3. The sheet discharge device 30 includes a processing tray section 35 and a discharge tray 37, and is configured to perform processing, in the processing section 36, on the sheet P discharged to the processing tray section 35 and discharge the sheet P to the discharge tray 37. An example of the processing performed by the processing section 36 is stapling or punching. In the present embodiment, the sheet discharge device 30 discharges the sheet P delivered from the intermediate unit 3 through the discharge path 23 and transported through the transport path 31.

The processing unit 4 includes a first transport roller pair 32 and a second transport roller pair 33 that transport the sheet P in the +Y direction and that transports the sheet P toward the sheet discharge device 30.

In the +Y direction with respect to the second transport roller pair 33, a transport section 34 configuring the sheet discharge device 30 is disposed. The transport section 34 transports the sheet P by a transport belt 40 as illustrated in FIG. 2. The transport section 34 is configured to be able to transport the sheet P in both the +Ya direction and the −Ya direction.

More specifically, the transport belt 40 in the transport section 34 is configured to be able to transport the sheet P in the +Ya direction and the −Ya direction by rotating while adsorbing the sheet P. The transport belt 40 is disposed above the sheet P to be transported. That is, the transport belt 40 is configured to adsorb and transport the sheet P from above.

Figure 2:
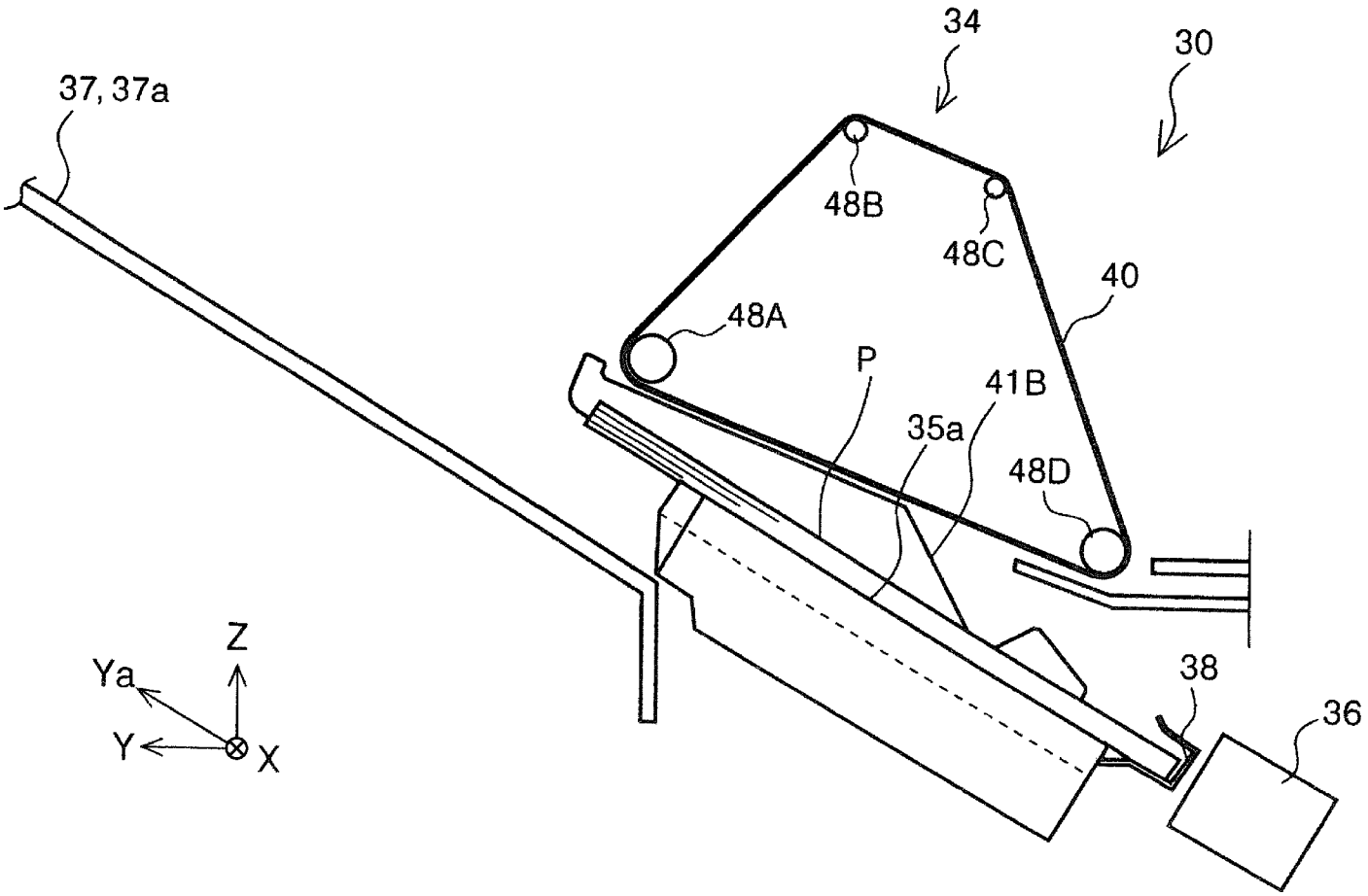
FIG. 2 is a side view of a main portion of a sheet processing apparatus.
Figure 3:
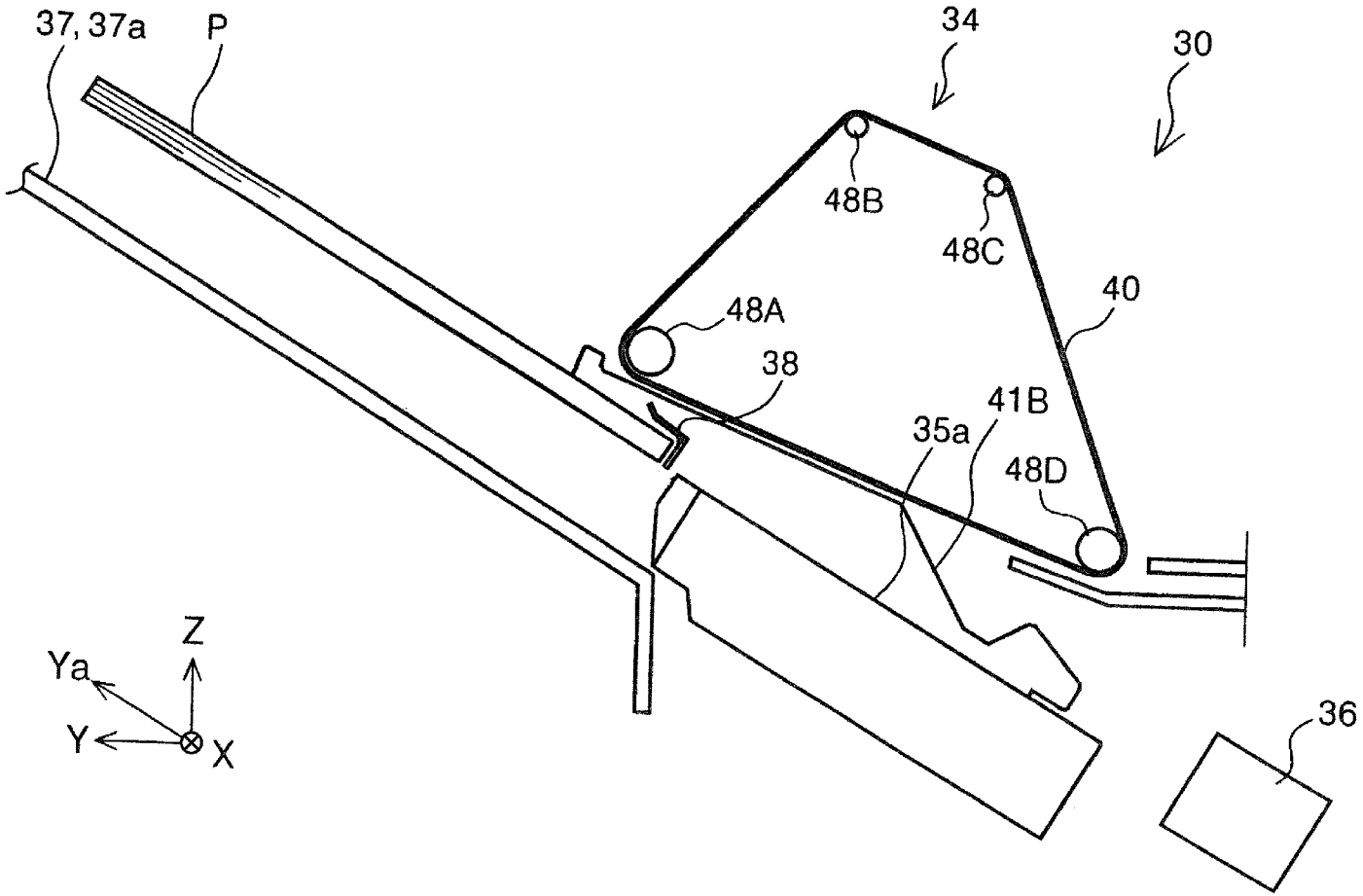
FIG. 3 is a side view of a main portion of the sheet processing apparatus.

As illustrated in FIG. 2, the annular transport belt 40 is looped around four rollers of a first roller 48A, a second roller 48B, a third roller 48C, and a fourth roller 48D. The fourth roller 48D is configured to be rotatable both clockwise and counterclockwise by power of a drive source (not illustrated).

When the fourth roller 48D rotates clockwise, the transport belt 40 also rotates clockwise, and the sheet P adsorbed to the transport belt 40 is transported in the +Ya direction. Conversely, when the fourth roller 48D rotates counterclockwise, the transport belt 40 also rotates counterclockwise, and the sheet P adsorbed by the transport belt 40 is transported in the −Ya direction.

A plurality of suction holes (not illustrated) are formed in the transport belt 40, and a suction fan (not illustrated) generates a negative pressure in the suction holes, whereby the sheet P is adsorbed to the surface of the transport belt 40.

The transport belt 40 adsorbs the sheet P delivered by the second transport roller pair 33 (see FIG. 1) and transports the sheet P in the +Ya direction. When the end portion in the −Ya direction, that is, the rear end of the sheet P is transported to a predetermined position, the sheet P is transported in the −Ya direction. In this case, a peeling member (not illustrated) peels the sheet P from the transport belt 40, whereby the sheet P drops onto the processing tray section 35 and is mounted. The adsorption of the sheet P by the transport belt 40 is not limited to the suction and adsorption type, but may be an electrostatic adsorption type.

As illustrated in FIG. 2, the rear end of the sheet P, which has dropped on a sheet mounting surface 35*a* of the processing tray section 35, comes into contact with the rear end alignment section 38, and the position thereof is arranged. When a plurality of sheets P are mounted on the processing tray section 35, the rear ends are aligned by the rear end alignment section 38.

In the sheet discharge device 30 illustrated in FIG. 2, the rear ends of the sheets P are aligned by the rear end alignment section 38. Processing such as stapling is performed on one or a plurality of sheets P mounted on the processing tray section 35 by the processing section 36 provided in the −Ya direction with respect to the processing tray section 35. In the present embodiment, the processing section 36 is configured to perform the stapling of hitting a binding needle at the rear end of the sheet P. As illustrated in a change from FIG. 2 to FIG. 3, the sheet P processed by the processing section 36 is moved to the discharge tray 37 by the rear end alignment section 38 provided to be movable by a drive section (not illustrated).

Embodiment 1

Hereinafter, a sheet processing apparatus according to Embodiment 1 of the present disclosure will be described in detail with reference to FIGS. 4 to 9.

The sheet processing apparatus 4 according to Embodiment 1 includes a transport section 34 transporting a sheet P; a processing tray section 35 including a sheet mounting surface 35*a* on which the transported sheet P is mounted and a processing section 36 that performs processing on the sheet P; a side edge alignment section 41 that is provided on the processing tray section 35 and aligns side edges of the sheet P; a lower support section 80 that is provided downstream of the processing tray section 35 in a transport direction F of the sheet P and supports the sheet P from below; and a discharge tray 37 located below the lower support section 80 in a sheet stacking direction orthogonal to the sheet mounting surface 35*a* of the processing tray section 35.

The side edge alignment section 41 performs a shift operation of shifting the sheet P in a direction orthogonal to the transport direction F of the sheet P, and the lower support section 80 is configured to move in the shift direction in conjunction with the movement of the sheet P in a state of supporting the sheet P from below during the shift operation by the side edge alignment section 41.

In the present embodiment, the control section 15 is configured to cause the side edge alignment section 41 and the lower support section 80 to perform the "shift operation" and the "movement in the shift direction in conjunction therewith" by a control signal.

Hereinafter, each component of the sheet processing apparatus 4 will be specifically described with reference to FIGS. 4 to 6.

Side Edge Alignment Section

Figure 5:
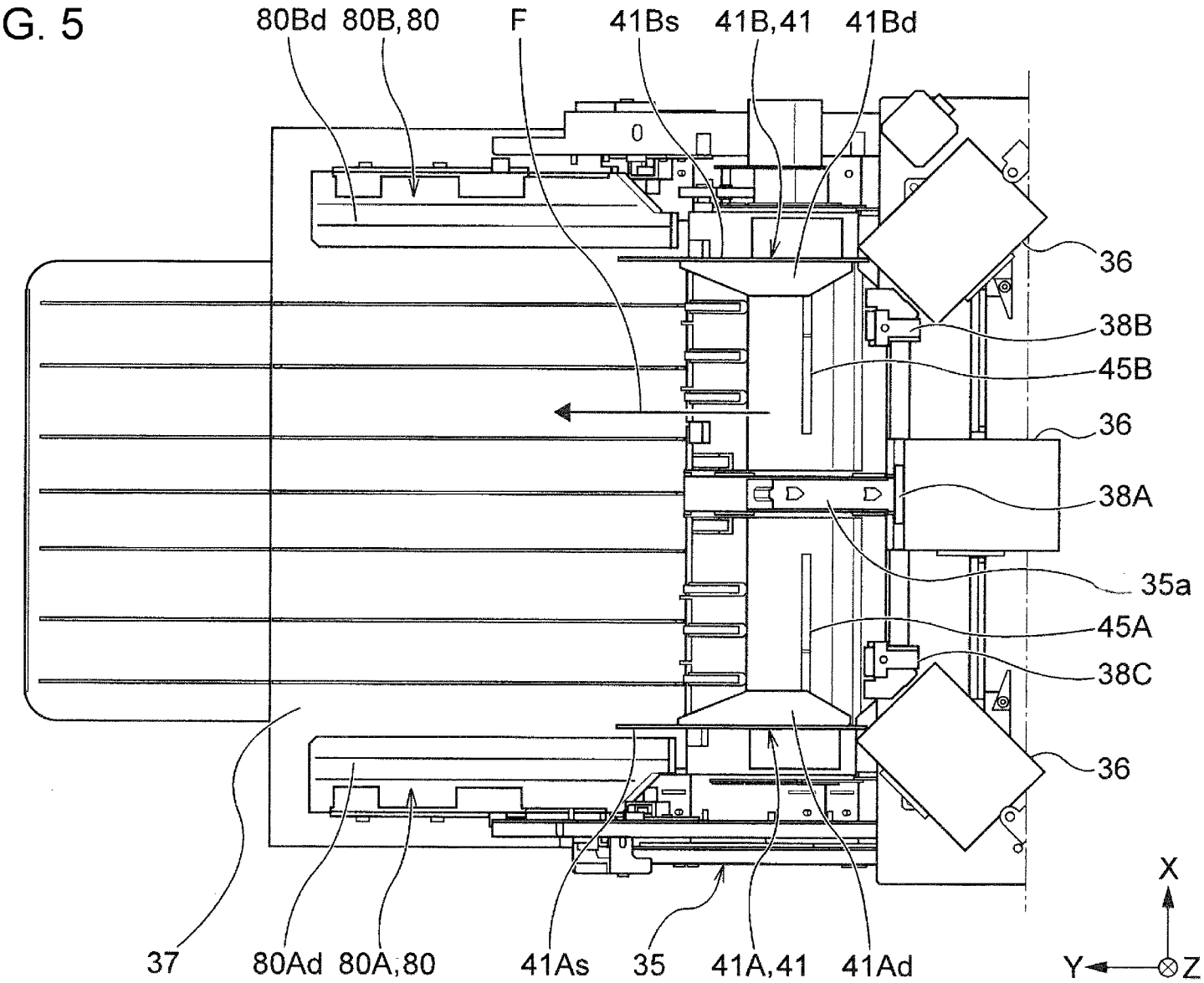
FIG. 5 is a plan view of a main portion of the same according to Embodiment 1.
Figure 6:
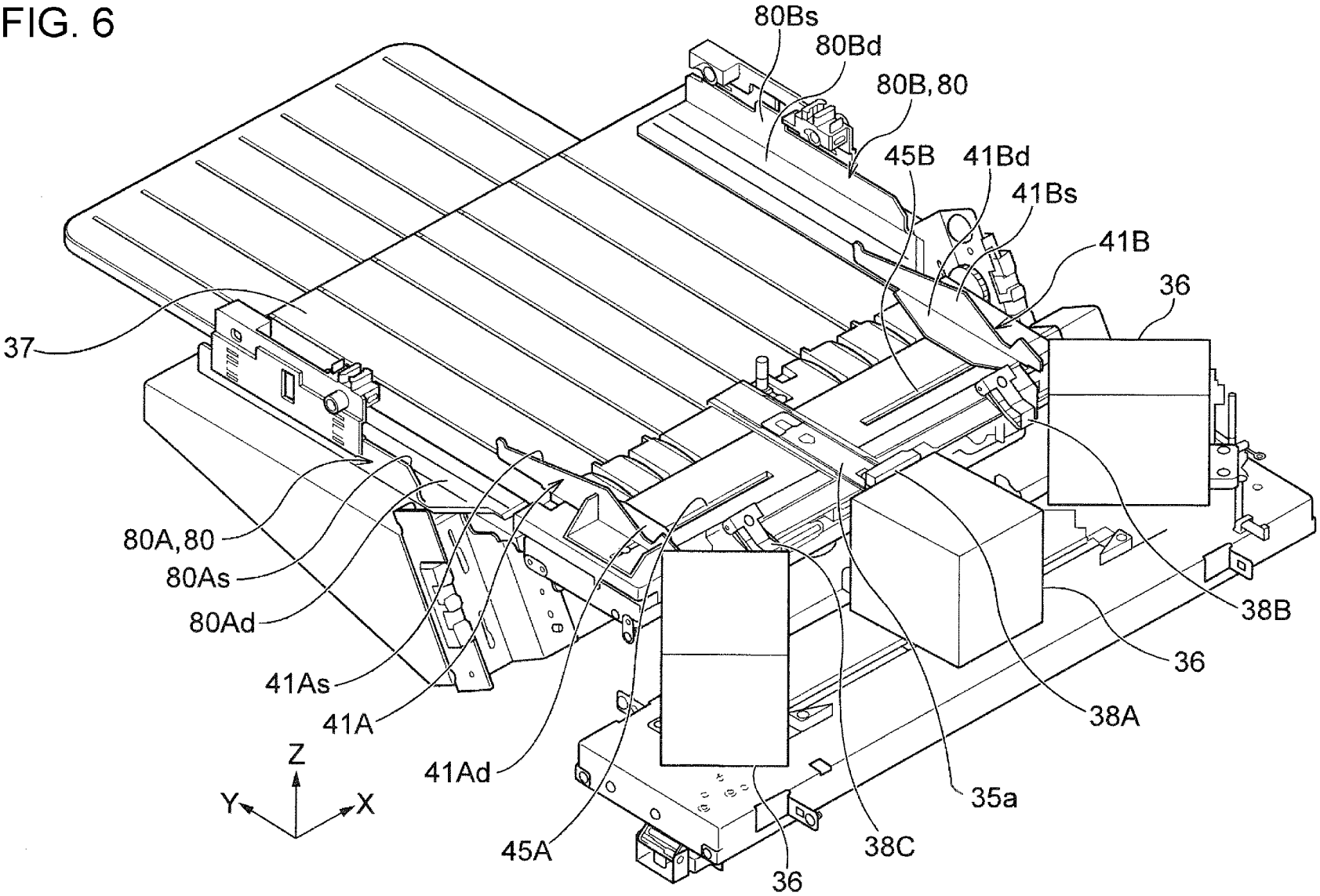
FIG. 6 is a perspective view of a main portion of the same according to Embodiment 1.

As illustrated in FIGS. 5 and 6, in the present embodiment, the side edge alignment section 41 includes a set of a first alignment portion 41A and a second alignment portion 41B located on both sides in the width direction of the sheet P.

The first alignment portion 41A and the second alignment portion 41B are configured to be able to perform the shift operation in a state in which the sheet P is pinched in the width direction. That is, the first alignment portion 41A and the second alignment portion 41B are configured to be movable in the X-axis direction by a drive section (not illustrated). In FIG. 5, reference numerals 45A and 45B are guide slits for moving the first alignment portion 41A and the second alignment portion 41B.

The first alignment portion 41A includes a first side support portion 41A*d* having a support surface for supporting one side portion of the sheet P from below, and a first side holding portion 41A*s* having a side surface capable of holding one side portion of the sheet P from a side. In addition, the second alignment portion 41B includes a second side support portion 41B*d* having a support surface for supporting the other side portion of the sheet P from below, and a second side holding portion 41B*s* having a side surface capable of holding the other side portion of the sheet P from a side.

Lower Support Section

Figure 4:
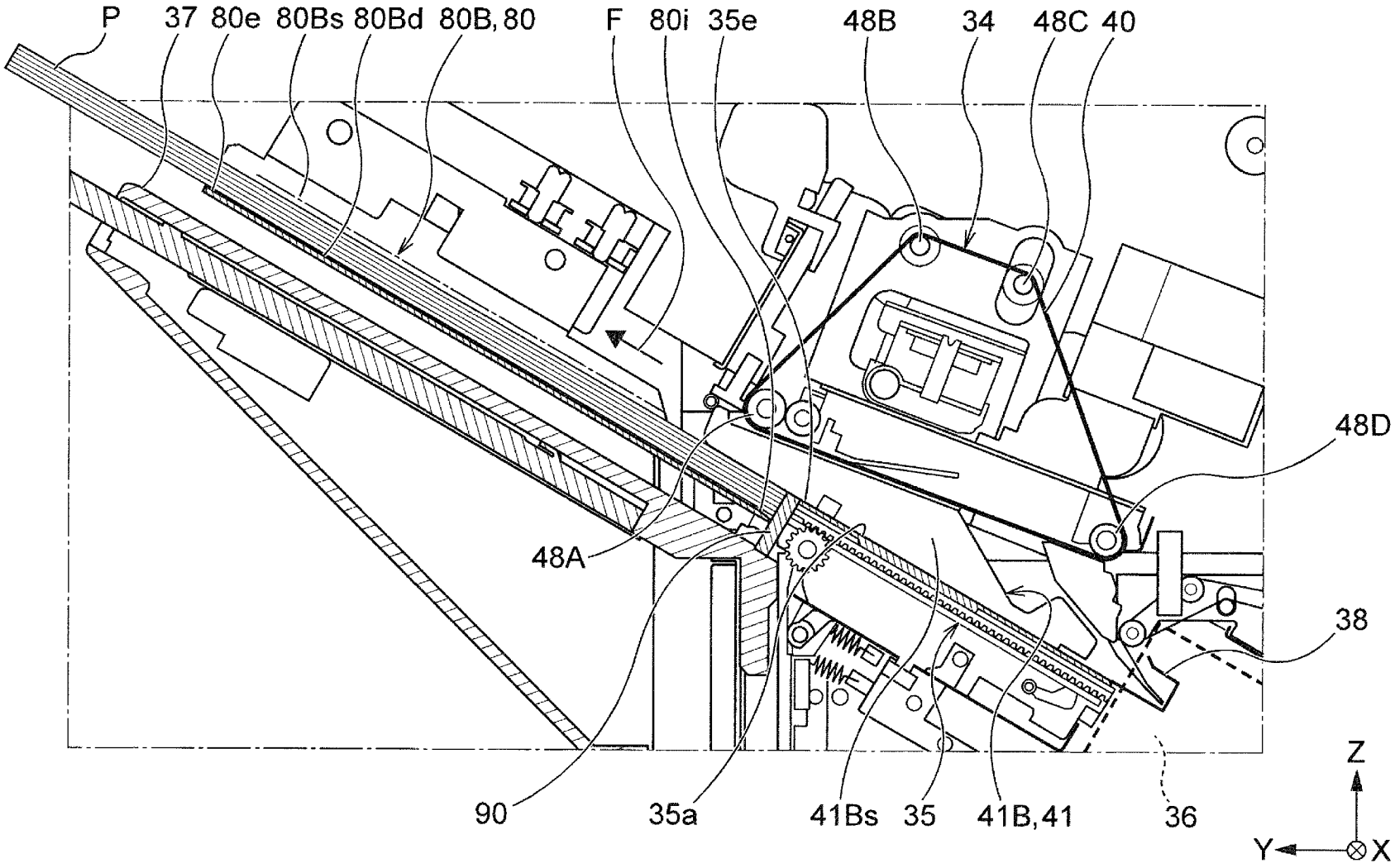
FIG. 4 is an YZ sectional view of a main portion of the sheet processing apparatus according to Embodiment 1.

As illustrated in FIGS. 4 to 6, in the present embodiment, the lower support section 80 includes a set of a first lower support 80A and a second lower support 80B that support the sheet P from below on both sides in the width direction.

Further, the first lower support 80A and the second lower support 80B are configured to be able to move in the shift direction in a state of pinching the sheet P in the width direction during the shift operation. That is, the first lower support 80A and the second lower support 80B are configured to be movable by a drive section (not illustrated) in the X-axis direction which is the shift direction.

The first lower support 80A includes a first side support portion 80A*d* having a support surface for supporting one side portion of the sheet P from below, and a first side holding portion 80A*s* having a side surface capable of holding one side portion of the sheet P from the side. In addition, the second lower support 80B includes a second side support portion 80B*d* having a support surface for supporting the other side portion of the sheet P from below, and a second side holding portion 80B*s* having a side surface capable of holding the other side portion of the sheet P from the side.

As illustrated in FIG. 4, in the present embodiment, an upstream end 80*i* of the lower support section 80 is configured to be located below the downstream end 35*e* of the processing tray section 35 in the sheet stacking direction orthogonal to the sheet mounting surface 35*a* of the processing tray section 35.

Therefore, in a state in which the sheet P is supported from below by both the sheet mounting surface 35*a* of the processing tray section 35 and the lower support section 80, a side shape of the sheet P is not a straight line but a non-linear shape such as a Z shape or an S shape.

Figure 11A:
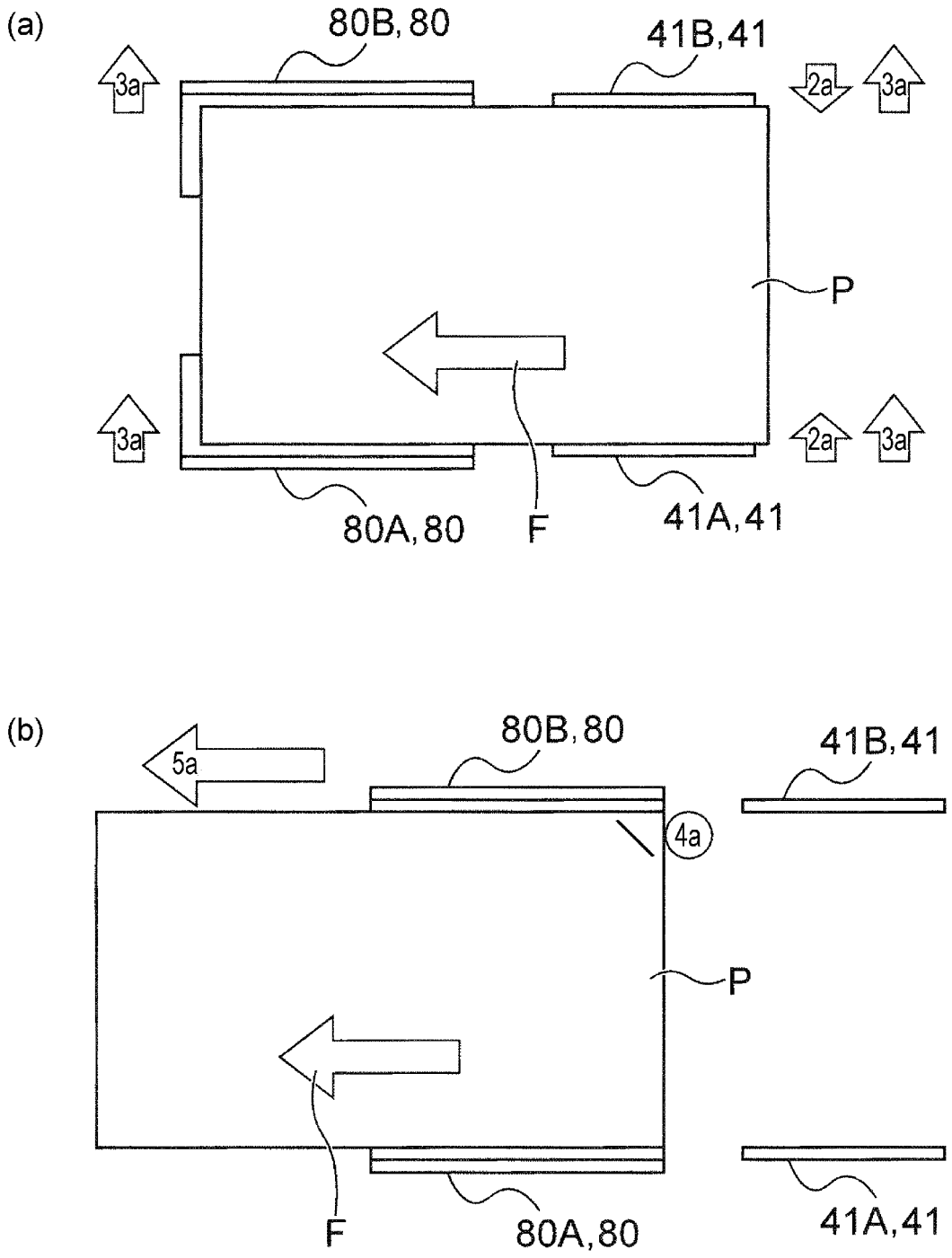
FIG. 11A is an explanatory view of an operation of the same according to Embodiment 3.
Figure 11B:
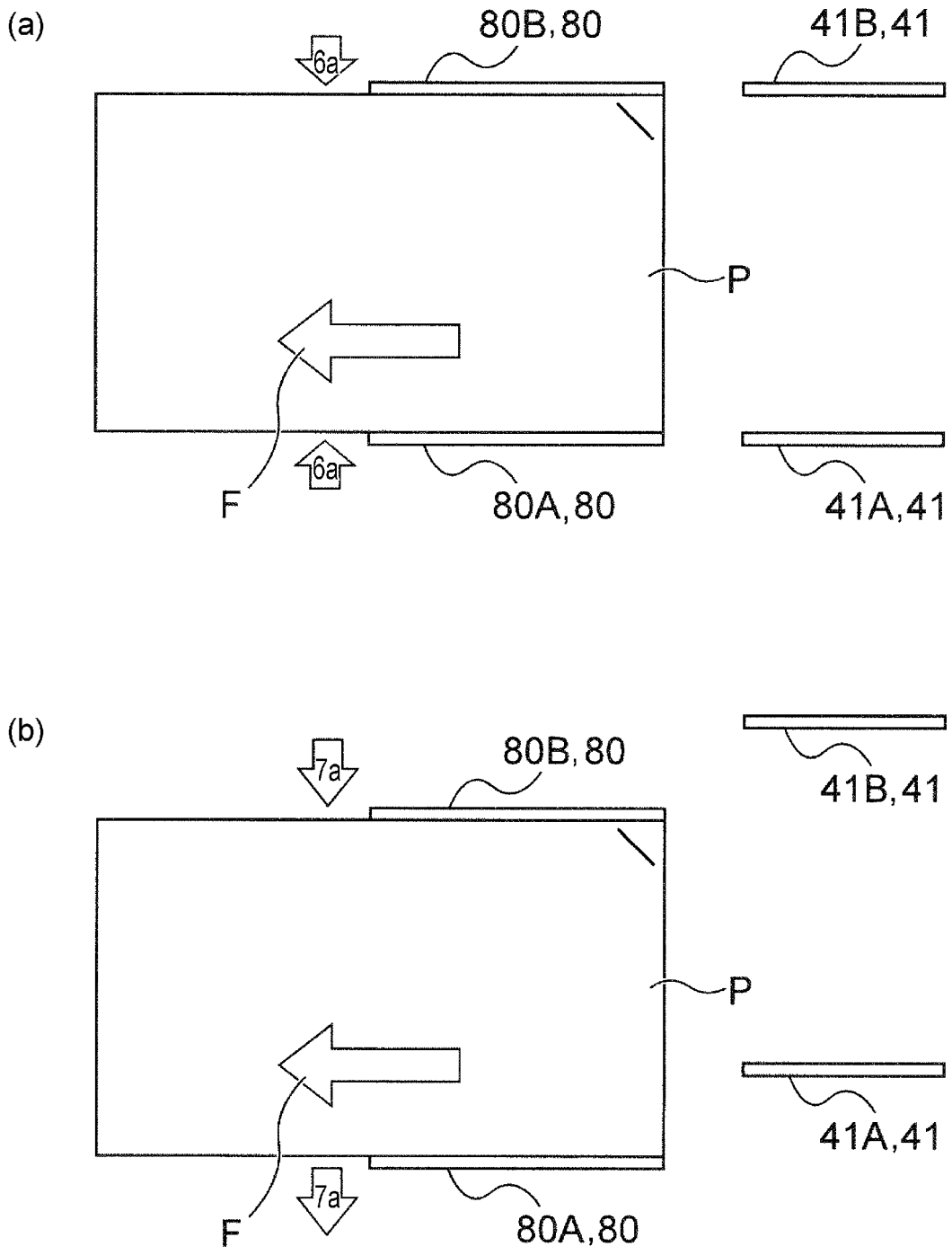
FIG. 11B is an explanatory view of an operation of the same according to Embodiment 3.
Figure 11C:
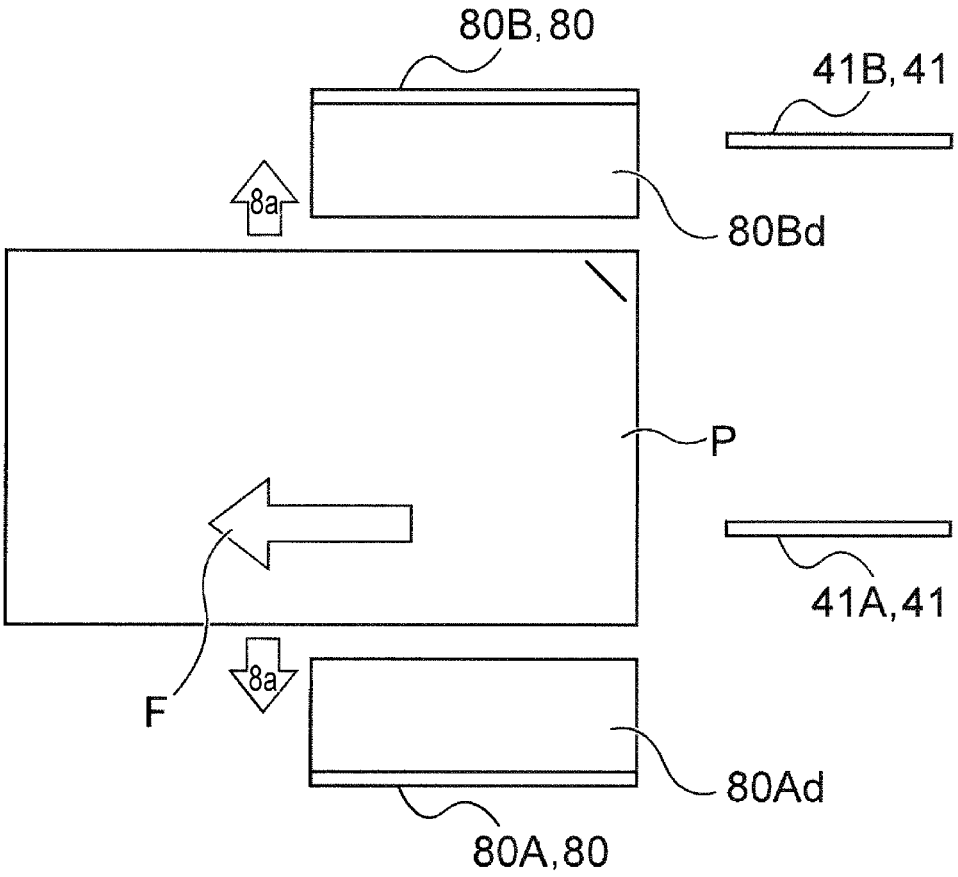
FIG. 11C is an explanatory view of an operation of the same according to Embodiment 3.

Further, in the present embodiment, as illustrated in FIGS. 11B and 11C described later, the lower support section 80 is provided to be movable to a support position (FIG. 11B) for supporting the sheet P and a retreat position (FIG. 11C). The lower support section 80 is configured to drop the sheet P onto the discharge tray 37 and discharge the sheet P by moving from the support position to the retreat position.

Rear End Alignment Section

As illustrated in FIGS. 5 and 6, in the present embodiment, a plurality of rear end alignment sections 38 are provided in the X-axis direction, and are configured of a rear end alignment section 38A at a center in the X-axis direction, a rear end alignment section 38B in the +X direction with respect to the rear end alignment section 38A, and a rear end alignment section 38C in the −X direction with respect to the rear end alignment section 38A.

In addition, as illustrated in FIG. 4, in the present embodiment, the lower support section 80 is provided to be inclined with the downstream end 80*e* facing upward with respect to the horizontal direction. An upright wall 90 is provided, as a rear end alignment surface, at the upstream end 80*i* of the lower support section 80 in the transport direction F of the sheet P to align the rear end of the sheet P. The upright wall 90 is also an upright wall of the discharge tray 37 in the present embodiment. That is, the upright wall 90 of the lower support section 80 and the upright wall of the discharge tray 37 are the same. Of course, the upright wall 90 of the lower support section 80 and the upright wall of the discharge tray 37 may not be the same or may be provided separately. Therefore, it is possible to arrange and align the rear end of the sheet P by the upright wall 90 with respect to the bundle of sheets P in a state of being supported by the lower support section 80 from below, and discharge the sheet P to the discharge tray 37.

In addition, a structure may be provided in which a rear end alignment surface (not illustrated) is formed on the upstream end of the lower support section 80 separately from the upright wall 90. The rear end alignment surface is provided substantially parallel to the upright wall 90 of the discharge tray 37, so that the rear end of the sheet P after the discharge can be easily aligned.

Description of Operation and Effect of Embodiment 1

Figure 7A:
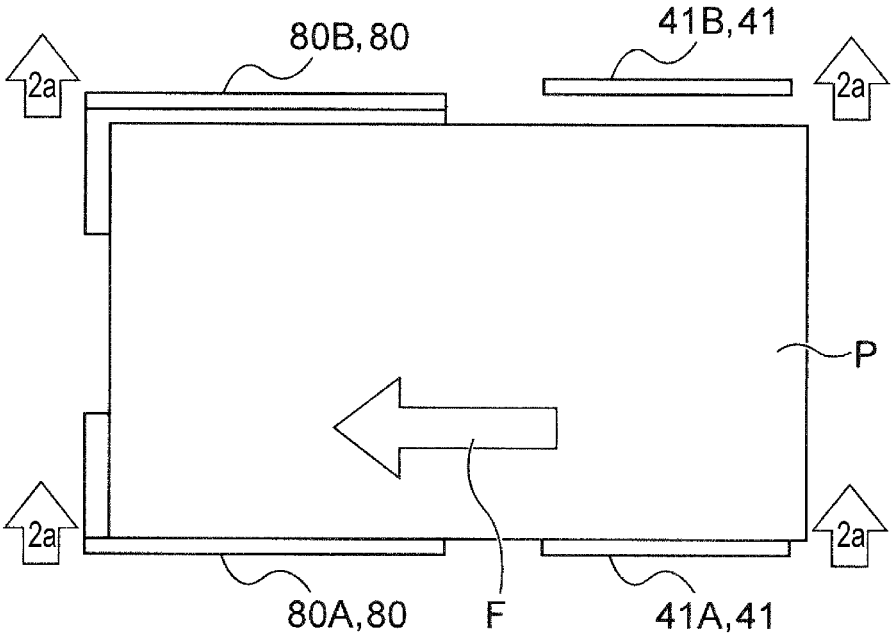
FIGS. 7A and 7B are an explanatory view of an operation of the same according to Embodiment 1.
Figure 7B:
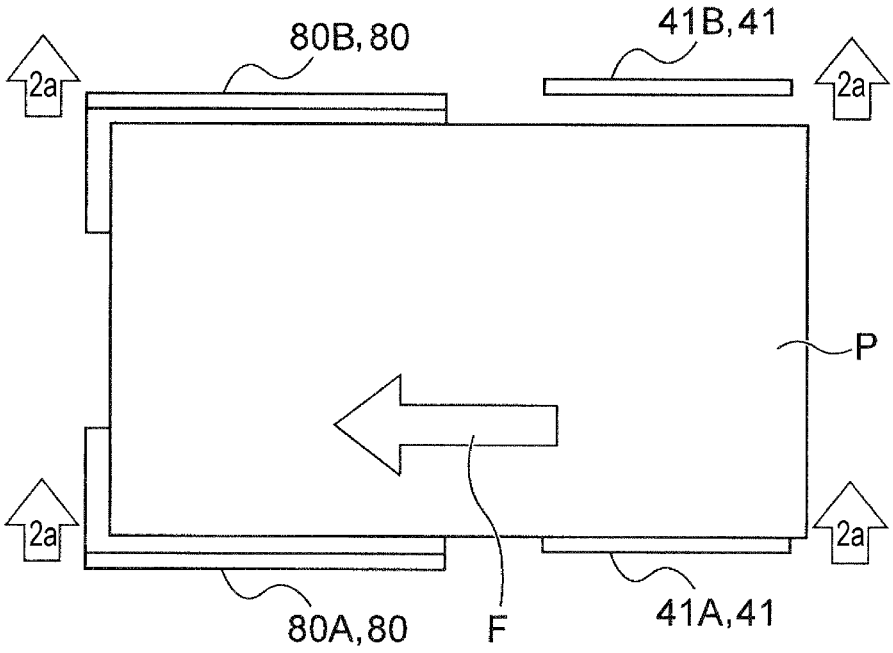

1. As illustrated in FIG. 7, the shift operation of the bundle of sheets P, which is transported on the sheet mounting surface 35*a* of the processing tray section 35 and created by the rear end alignment section 38 and the side edge alignment section 41, is performed, as illustrated by arrows 2*a*, by moving the side edge alignment section 41 and the lower support section 80.

FIG. (A) on an upper side of FIG. 7 illustrates a case in which the bundle of sheets P is pressed and shifted by both the side edge alignment section 41 and the lower support section 80. The lower support section 80 moves in conjunction with the movement of the side edge alignment section 41 in a state of supporting the bundle of sheets P from below.

FIG. (B) on a lower side of FIG. 7 illustrates a case in which the bundle of sheets P is pressed by the side edge alignment section 41, and the lower support section 80 moves in the shift direction in conjunction with the lower support section 41 in a state in which the bundle of sheets P is supported from below without being pressed.

According to the present embodiment, the lower support section 80 moves in the shift direction in conjunction with the movement of the sheet P in a state of supporting the sheet P from below during the shift operation by the side edge alignment section 41. In other words, during the shift operation of the sheet P by the side edge alignment section 41, auxiliaries of the support, from below, of the lower support section 80 located downstream of the side edge alignment section 41 are added, so that a possibility that the sheet P is inclined during the shift operation can be reduced.

Figure 8A:
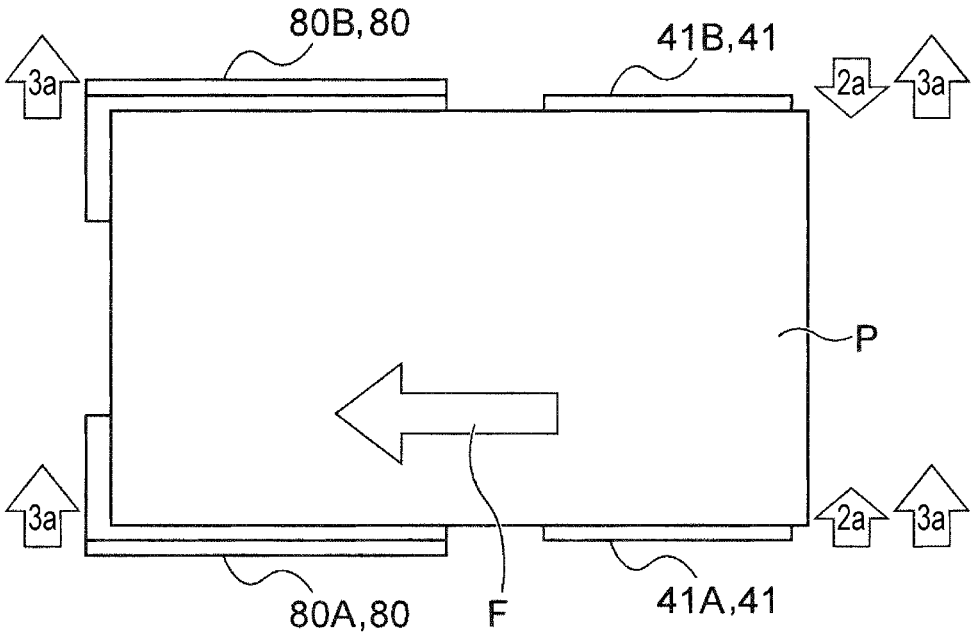
FIGS. 8A and 8B are an explanatory view of an operation of the same according to Embodiment 1.
Figure 8B:
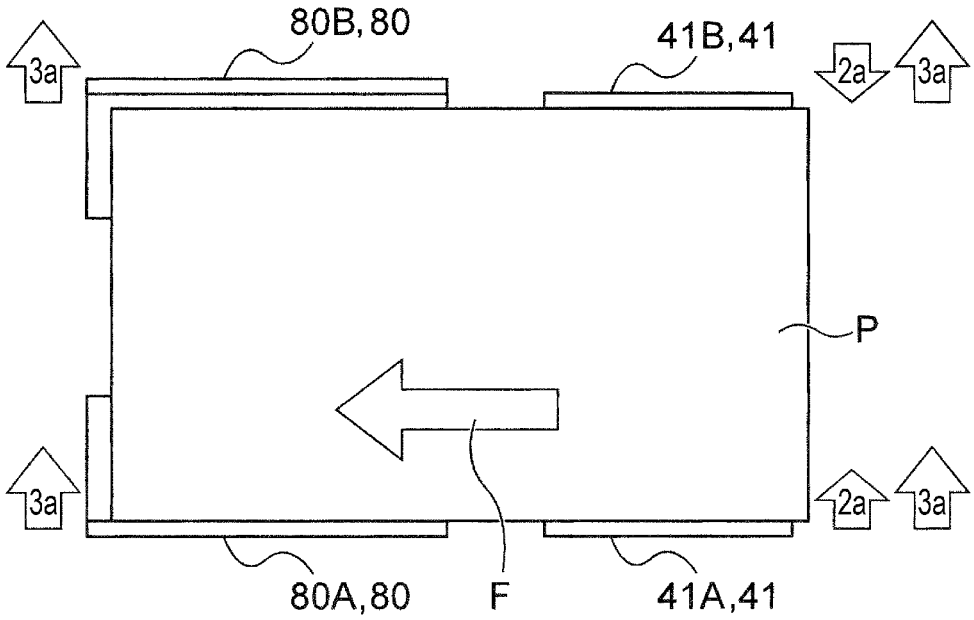

2. As illustrated in FIG. 8, the bundle of sheets P, which is transported on the sheet mounting surface 35*a* of the processing tray section 35 and created by the rear end alignment section 38 and the side edge alignment section 41, is pinched, as illustrated by arrows 2*a*, by the first alignment portion 41A and the second alignment portion 41B of the side edge alignment section 41 in the width direction. Next, as indicated by arrows 3*a*, the shift operation is performed by moving the side edge alignment section 41 and the lower support section 80.

FIG. (A) on an upper side of FIG. 8 illustrates a case in which the bundle of sheets P is pressed in a state of being pinched between the first alignment portion 41A and the second alignment portion 41B, and the lower support section 80 moves in the shift direction in conjunction with the side edge alignment section 41 in a state in which the bundle of sheets P is not pressed.

FIG. (B) on a lower side of FIG. 8 illustrates a case in which the bundle of sheets P is pinched between the first alignment portion 41A and the second alignment portion 41B, and the bundle of sheets P is pressed to be shifted by the first alignment portion 41A, the second alignment portion 41B, and the first lower support 80A of the lower support section 80.

According to the present embodiment, the shift operation is performed in a state in which the first alignment portion 41A and the second alignment portion 41B included in the side edge alignment section 41 pinch the sheet P in the width direction. As described above, the shift operation is performed in a state in which the first alignment portion 41A and the second alignment portion 41B pinch the sheet P in the width direction, so that the sheet P is stabilized during the shift movement as compared to a state in which the sheet P is simply supported by the side edge alignment section 41 from below. Thus, the shift operation can be stably performed.

Figure 9A:
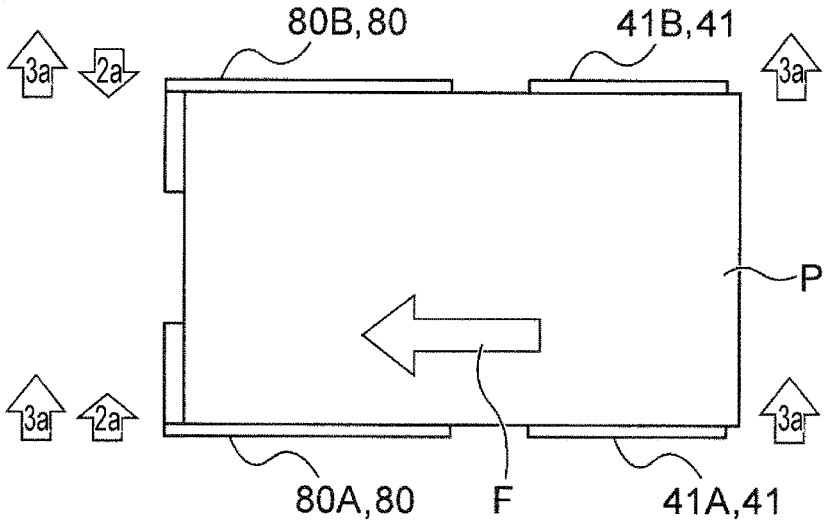
FIGS. 9A, 9B and 9C are an explanatory view of an operation of the same according to Embodiment 1.
Figure 9B:
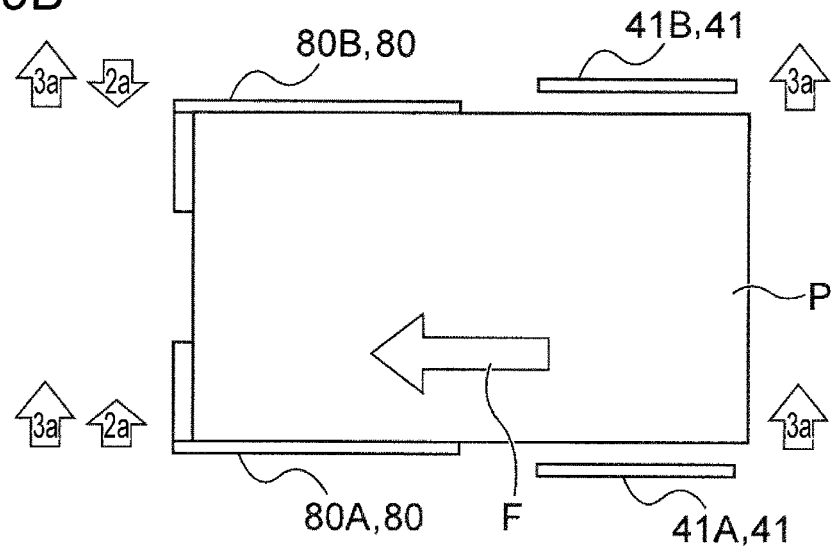
Figure 9C:
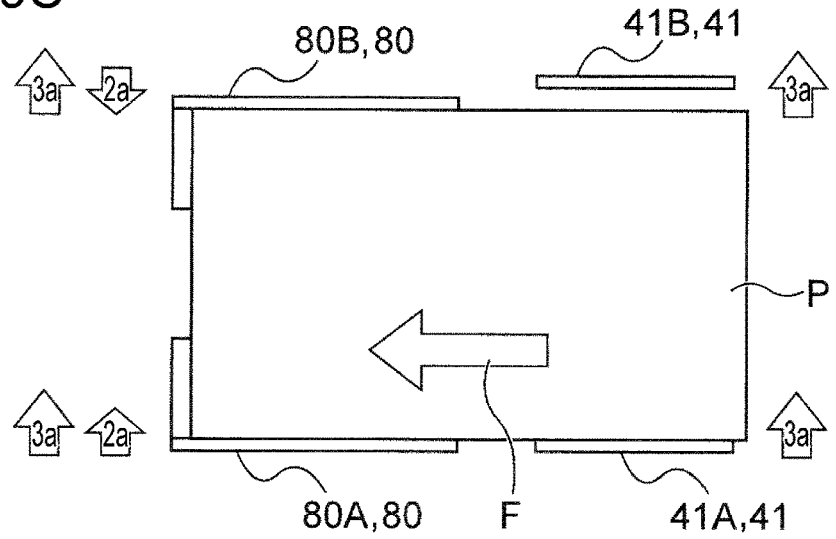

3. As illustrated in FIG. 9, the bundle of sheets P, which is transported on the sheet mounting surface 35*a* of the processing tray section 35 and created by the rear end alignment section 38 and the side edge alignment section 41, is pinched, as illustrated by arrows 2*a*, by the first lower support 80A and the second lower support 80B of the lower support section 80 portion in the width direction. Next, as indicated by arrows 3*a*, the shift operation is performed by moving the side edge alignment section 41 and the lower support section 80.

FIG. (A) on an upper side of FIG. 9 illustrates a case in which the bundle of sheets P moves in the shift direction in a state in which the bundle of sheets P is pinched between the first lower support 80A and the second lower support 80B, and in a state in which bundle of sheets P is pinched between the first alignment portion 41A and the second alignment portion 41B.

FIG. (B) intermediate of FIG. 9 illustrates a case in which the bundle of sheets P is pressed in a state of being pinched between the first lower support 80A and the second lower support 80B, and the side edge alignment section 41 moves in the shift direction in a state in which the bundle of sheets P is supported from below without being pressed. That is, there is a case in which the movement in the shift direction is performed in a state in which the bundle of sheets P is supported from below by the respective support surfaces of the first side support portion 41A*d* and the second side support portion 41B*d* (FIG. 5) of the side edge alignment section 41.

FIG. (C) on a lower side of FIG. 9 illustrates a case in which the bundle of sheets P is pressed by both the first alignment portion 41A included in the side edge alignment section 41 and the lower support section 80, and moves in the shift direction in a state in which the bundle of sheets P is pinched between the first lower support 80A and the second lower support 80B.

According to the present embodiment, the first lower support 80A and the second lower support 80B included in the lower support section 80 move in the shift direction in a state of pinching the sheet P from both sides in the width direction during the shift operation. Therefore, the sheet P is stabilized during the shift movement as compared to a state in which the sheet P is simply supported by the lower support section 80 from below. Thus, the shift operation can be stably performed.

4. In addition, according to the present embodiment, the upstream end 80*i* of the lower support section 80 is located below the downstream end 35*e* of the processing tray section 35 (FIG. 4).

Therefore, the side shape of the sheet P viewed in the shift movement direction is not a straight line but a non-linear shape such as a Z shape or an S-shape. Therefore, the sheet P is in a state of being stiff, that is, the rigidity increases with respect to an acting force received during the shift operation, and the sheet P can be stabilized during the movement in the shift direction.

5. Further, according to the present embodiment, the upright wall 90 is provided, as the rear end alignment surface for aligning the rear end of the sheet P, at the upstream end of the lower support section 80 in which the support surface of the sheet P is inclined with the front side in the transport direction F of the sheet P facing upward. Therefore, it is possible to arrange and align the rear end of the sheet P by the upright wall 90 with respect to the bundle of sheets P in a state of being supported by the lower support section 80 from below, and discharge the sheet P to the discharge tray 37.

6. Further, according to the present embodiment, the lower support section 80 discharges the sheet P to the discharge tray 37 by moving from the support position of the sheet P to the retreat position. Therefore, the lower support section 80 moves to a predetermined shift position, and then moves from the support position to the retreat position, and thereby the sheet P can be easily discharged to the predetermined shift position. Further, in this case, the discharge operation can be performed without the lower support section 80 coming into contact with the sheet P already discharged on the discharge tray 37.

Embodiment 2

Next, a sheet processing apparatus according to Embodiment 2 of the present disclosure will be described in detail with reference to FIG. 10. The same portions as those in Embodiment 1 are denoted by the same reference numerals, and description thereof will be omitted.

Figure 10A:
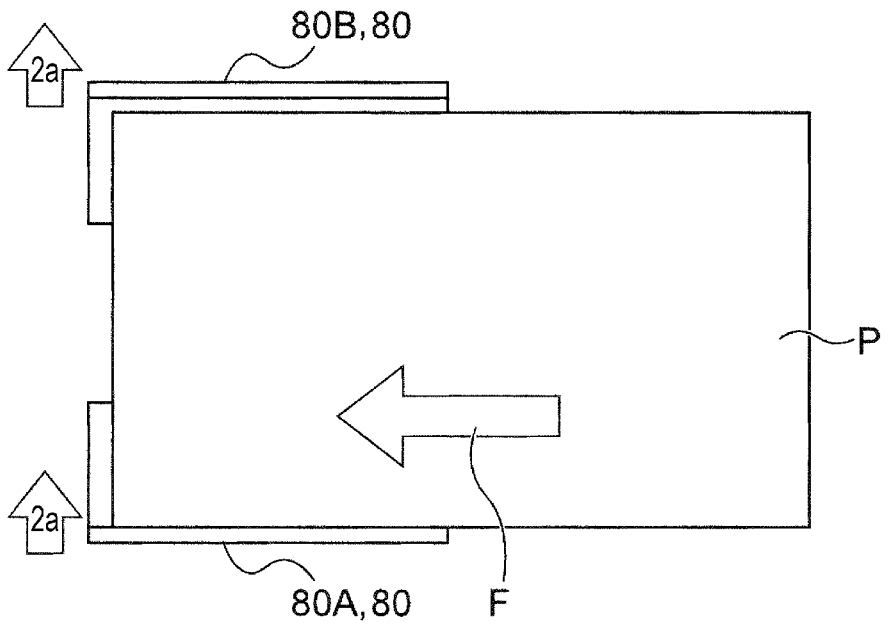
FIGS. 10A and 10B are an explanatory view of an operation of the same according to Embodiment 2.
Figure 10B:
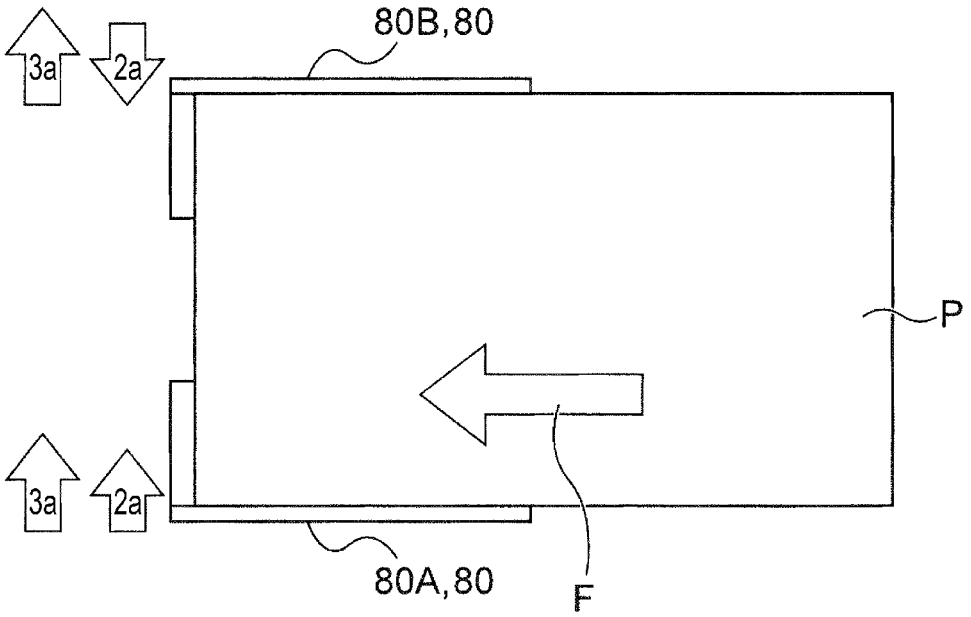

In Embodiment 2, as illustrated in FIG. 10, the lower support section 80 is configured to perform the shift operation of shifting the sheet P in a direction orthogonal to the transport direction F of the sheet P. That is, the lower support section 80 is configured to perform the shift operation of the sheet P.

As illustrated in FIG. 10, the shift operation of the bundle of sheets P transported onto the sheet mounting surface 35*a* of the processing tray section 35 and created by the rear end alignment section 38 and the side edge alignment section 41 is performed, as indicated by arrows 2*a*, by moving the lower support section 80.

FIG. (A) on an upper side of FIG. 10 illustrates a case in which the bundle of sheets P is pressed by the first lower support 80A of the lower support section 80 to perform the shift operation. The lower support section 80 moves in a state of supporting the bundle of sheets P from below.

FIG. (B) on a lower side of FIG. 10 illustrates a case in which, as illustrated by arrows 2*a*, the bundle of sheets P is pinched from both sides in the width direction by the first lower support 80A and the second lower support 80B of the lower support section 80, and then, as illustrated by arrows 3*a*, the bundle of sheets P is pressed by the first lower support 80A of the lower support section 80 and moves in the shift direction.

According to Embodiment 2, the lower support section 80 is provided downstream of the processing tray section 35 in the transport direction F of the sheet P. Therefore, an overall structure such as a size and a shape of the lower support section 80 can be set independently from the processing tray section 35.

Therefore, firstly, it is possible to provide a structure in which the shift operation is performed only by the lower support section 80. It is possible to cope with the sheet P which is long in a longitudinal direction. Further, by setting a contact area of a portion supporting the sheet P from below to be large, the sheet P can be stabilized during the shift movement by the lower support section 80.

According to Embodiment 2, a side shape of the sheet P viewed in the shift movement direction is not a straight line but a non-linear shape such as a Z shape or an S shape. Therefore, the sheet P is in a state of being stiff with respect to an acting force received during the shift operation by the lower support section 80, that is, rigidity increases, and the sheet P can be stabilized during the movement in the shift direction.

In Embodiment 2, the first alignment portion 41A and the second alignment portion 41B of the side edge alignment section 41 may move in the shift direction in a state of pinching the sheet P from both sides in the width direction, during the shift operation. That is, a configuration, in which the side edge alignment section 41 plays the auxiliary role of the lower support section 80 described with reference to FIGS. 7 to 9, is provided in FIGS. (A) and (B) of FIG. 10.

According to the present embodiment, the first alignment portion 41A and the second alignment portion 41B of the side edge alignment section 41 move in the shift direction in a state of pinching the sheet P in the width direction during the shift operation. Therefore, the sheet P can be stabilized during the movement in the shift direction as compared to a state in which the sheet P is simply supported by the side edge alignment section 41 from below. Thus, the shift operation can be stably performed.

Embodiment 3

Embodiment 3 of the sheet processing apparatus according to the present disclosure will be described in detail with reference to FIGS. 11A to 11C. Embodiment 3 is a case in which the step of the shift operation includes stapling.

In Embodiment 3, as illustrated in FIG. 11A, the bundle of sheets P, which is transported on the sheet mounting surface 35*a* of the processing tray section 35 and created by the rear end alignment section 38 and the side edge alignment section 41, is first pinched, as illustrated by arrows 2*a*, by the side edge alignment section 41 in the width direction.

Next, as indicated by arrows 3*a*, the shift operation is performed by moving the side edge alignment section 41 and the lower support section 80. The processing section 36 performs the stapling, and the shift operation is an operation to move to the position of the processing section 36.

Next, the stapling of the processing section 36 (FIG. 5) is performed as indicated by a circled 4. Next, as indicated by an arrow 5*a*, the bundle of sheets P is moved in the transport direction F and is located on the lower support section 80 in a state of passing through the area of the side edge alignment section 41. The movement of the sheet P in the transport direction F is performed by the rear end alignment section 38 (see FIG. 3).

FIG. (a) on an upper side of FIG. 11A is a view for explaining the operation corresponding to the arrows 2*a* and 3*a*, and FIG. (b) on a lower side thereof is a view for explaining the operation corresponding to the arrow 5*a* from the stapling (circled 4).

Next, in FIG. 11B, as indicated by arrows 6*a*, the bundle of sheets P is pinched between the lower support sections 80 in the width direction. Next, as indicated by the arrow 7*a*, the shift operation is performed by moving the lower support sections 80. Here, the sheet P is moved to a center position in the width direction (X-axis direction) of the discharge tray 37.

FIG. (a) on an upper side of FIG. 11B is a view for explaining the operation corresponding to the arrows 6*a*, and FIG. (b) on a lower side thereof is a view for explaining the operation corresponding to the arrows 7*a*.

Next, in FIG. 11C, as illustrated by arrows 8*a*, the lower support section 80 is moved from the support position to the retreat position. Therefore, the sheet P is released from being supported by the lower support section 80, and the sheet P drops onto the discharge tray 37 to be discharged.

According to the present embodiment, it is possible to perform the discharging operation without causing the sheet P on which the stapling or the like has been performed in the processing section 36 (FIG. 5) to come into contact with the sheet already mounted on the discharge tray 37.

OTHER EMBODIMENTS

Although the sheet processing apparatus 4 according to the embodiment of the present disclosure basically has the above-described configurations, of course, a partial configuration change or omission can be made without departing from the gist of the present disclosure.

When the lower support section 80 is in conjunction with the movement of the side edge alignment section 41, the lower support section 80 and the end of the sheet P may or may not come into contact with each other.

What is claimed is:

1. A sheet processing apparatus comprising:

a transport section transporting a sheet;

a processing tray section having a sheet mounting surface on which the transported sheet is mounted and a processing section that performs processing on the sheet;

a side edge alignment section that is provided on the processing tray section and aligns a side edge of the sheet;

a lower support section that is provided downstream of the processing tray section in a transport direction of the sheet and supports the sheet from below; and a discharge tray located below the lower support section in a sheet stacking direction orthogonal to the sheet mounting surface of the processing tray section, wherein the side edge alignment section performs a shift operation of shifting the sheet in a shift direction orthogonal to the transport direction of the sheet, and the lower support section moves in the shift direction in conjunction with a movement of the sheet in a state of supporting the sheet from below during the shift operation by the side edge alignment section.

2. The sheet processing apparatus according to claim 1, wherein the side edge alignment section includes;

a set of a first alignment portion and a second alignment portion located on both sides of the sheet in a width direction, and the first alignment portion and the second alignment portion perform the shift operation in a state of pinching the sheet in the width direction.

3. The sheet processing apparatus according to claim 1, wherein the lower support section includes;

a set of a first lower support and a second lower support supporting the sheet from below on both sides in a width direction, and the first lower support and the second lower support move in the shift direction in a state of pinching the sheet from both sides in the width direction, during the shift operation.

4. A sheet processing apparatus comprising:

a transport section transporting a sheet;

a processing tray section on which the transported sheet is mounted and which performs processing on the sheet;

a side edge alignment section that is provided on the processing tray section and aligns a side edge of the sheet;

a lower support section that is provided downstream of the processing tray section in a transport direction of the sheet and supports the sheet from below; and a discharge tray located below the lower support section in a sheet stacking direction orthogonal to a sheet mounting surface of the processing tray section, wherein the lower support section performs a shift operation of shifting the sheet in a shift direction orthogonal to the transport direction of the sheet.

5. The sheet processing apparatus according to claim 4, wherein the lower support section includes;

a set of a first lower support and a second lower support supporting the sheet from below on both sides in a width direction, and the first lower support and the second lower support perform the shift operation in a state of pinching the sheet from both sides in the width direction, during the shift operation.

6. The sheet processing apparatus according to claim 4, wherein the side edge alignment section moves in the shift direction in conjunction with a movement of the sheet during the shift operation.

7. The sheet processing apparatus according to claim 1, wherein an upstream end of the lower support section is located below a downstream end of the processing tray section in the sheet stacking direction orthogonal to the sheet mounting surface of the processing tray section.

8. The sheet processing apparatus according to claim 1, wherein the lower support section is provided to be inclined with a downstream end upward with respect to a horizontal direction, and a rear end alignment surface that aligns a rear end of the sheet is provided at an upstream end of the lower support section in the transport direction of the sheet.

9. The sheet processing apparatus according to claim 1, wherein the lower support section is configured to move between a support position for supporting the sheet and a retreat position, and causes the sheet to be discharged to the discharge tray by moving from the support position to the retreat position.

10. The sheet processing apparatus according to claim 4, wherein an upstream end of the lower support section is located below a downstream end of the processing tray section in the sheet stacking direction orthogonal to the sheet mounting surface of the processing tray section.

11. The sheet processing apparatus according to claim 4, wherein the lower support section is provided to be inclined with a downstream end upward with respect to a horizontal direction, and a rear end alignment surface that aligns a rear end of the sheet is provided at an upstream end of the lower support section in the transport direction of the sheet.

12. The sheet processing apparatus according to claim 4, wherein the lower support section is configured to move between a support position for supporting the sheet and a retreat position, and causes the sheet to be discharged to the discharge tray by moving from the support position to the retreat position.

* * * * *